US006836171B1

(12) United States Patent
Weedon

(10) Patent No.: US 6,836,171 B1
(45) Date of Patent: Dec. 28, 2004

(54) APPARATUS FOR PROVIDING CONTINUOUS INTEGRATION OF AN INPUT SIGNAL WHILE ALLOWING READOUT AND RESET FUNCTIONS

(75) Inventor: Hans J. Weedon, Salem, MA (US)

(73) Assignee: Analogic Corporation, Peabody, MA (US)

( * ) Notice: Subject to any disclaimer, the term of this patent is extended or adjusted under 35 U.S.C. 154(b) by 0 days.

(21) Appl. No.: 10/454,104

(22) Filed: Jun. 4, 2003

Related U.S. Application Data

(60) Provisional application No. 60/386,152, filed on Jun. 5, 2002.

(51) Int. Cl.[7] ..... G06F 7/64; G06F 7/18

(52) U.S. Cl. ..... 327/336; 327/337; 327/344; 327/345

(58) Field of Search ..... 327/336, 337, 327/339, 344, 345, 552, 554

(56) References Cited

U.S. PATENT DOCUMENTS 4,550,295 A * 10/1985 Sasaki ..... 333/19
5,479,130 A * 12/1995 McCartney ..... 327/341
5,949,666 A * 9/1999 Daniele et al. ..... 363/43

* cited by examiner

*Primary Examiner*—Tuan T. Lam
(74) *Attorney, Agent, or Firm*—McDermott Will & Emery

(57) ABSTRACT

An integration circuit includes an input node for receiving an input charge, an integrator having an input terminal coupled to the input node, an output terminal and a first charge storage device coupled between the input and output terminals, an intermediate node coupled between the input terminal and ground, a second charge storage device having a first terminal coupled to the intermediate node and a second terminal coupled to an output node of the integration circuit and an isolation device coupled between the integrator and the second charge storage device for selectively isolating the integrator from the second charge storage device. During a first phase of operation, the isolation device is activated and isolates the integrator from the second charge storage device, and the input charge received on the input terminal of the integrator is stored on the first charge storage device. During a second phase of operation, the isolation device is deactivated and enables and the charge stored on the first charge storage device to be transferred to the second charge storage device.

16 Claims, 4 Drawing Sheets

APPARATUS FOR PROVIDING CONTINUOUS INTEGRATION OF AN INPUT SIGNAL WHILE ALLOWING READOUT AND RESET FUNCTIONS

RELATED APPLICATION

This application claims the benefit of U.S. Provisional Patent Application Ser. No. 60/386,152, filed Jun. 5, 2002.

FIELD OF THE INVENTION

The present invention relates generally to an integrator which is capable of continuous integration while allowing readout and reset functions, and more particularly to an integrator which is capable of integrating an input charge and enabling a readout and reset of the integrator without disconnecting the input charge from the input amplifier and without loosing any of the input charge during the readout and reset functions.

BACKGROUND OF THE INVENTION

A computerized tomography (CT) scanner includes a highly stable X-ray beam generator that generates an X-ray beam that is focused on a specific plane of the body. As this beam passes through the body, it is picked up by a detector, which feeds the information it receives into a computer. The computer then analyzes the information on the basis of tissue density. This analyzed data is then fed into a cathode ray tube and a picture of the X-rayed, cross-section of the body is produced. Bone shows up as white; gases and liquids as black; and, tissue as varying shades of gray, depending on its density.

It is extremely important for the circuitry associated with the detector to collect and process all of the energy received by the detector to insure accurate scans. The devices that receive the energy as an input charge must be able to continuously integrate the input charge even during readout and reset functions, so that none of the input charge is unaccounted for. Shown in FIG. 1 is a prior art circuit 100 for integrating such an input charge. Circuit 100 includes a pair of integrators 102*a* and 102*b* in which one of the integrators collects the input charge $I_{in}$ and processes it while the other integrator is read out from the previous integration and reset.

When conducting a CT scan, it is critical that the readings provided by the integrators be accurate to approximately 0.03%. However, it is virtually impossible to construct the capacitors 104*a* and 104*b* associated with the integrators 102*a* and 102*b*, respectively, to a tolerance that will allow the required accuracy. This results in differences in the offsets and gains of the integrators 102*a* and 102*b* with respect to each other. Accordingly, tables for each integrator must be constructed to correct for the differences in the offset and gain that result from inaccuracies in the construction of the components of the integrators, in particular the capacitors 104*a* and 104*b*. Utilization of such tables requires additional software for processing the collected charge and introduces undesired complexity to the circuit.

SUMMARY OF THE INVENTION

The present invention is directed to an integration device which is capable of continuously integrating an input charge while also allowing for readout and reset functions without losing any of the input charge. The device does not require more than a single set of correction tables, as the input charge is read out from a single capacitor.

According to one embodiment, an integration circuit includes an input node for receiving an input charge, an integrator including a first amplifier having an input terminal coupled to the input node, an output terminal and a first charge storage device coupled between the input and output terminals, an intermediate node coupled between the input node and ground, a second charge storage device having a first terminal coupled to the intermediate node and a second terminal coupled to an output node of the integration circuit, a first switch device coupled between the input node and the intermediate node; and a second switch device coupled between the output terminal of the integrator and the output node. During a first phase of operation, the first and second switch devices are open, and the input charge received on the input terminal of the integrator is stored on the first charge storage device. During a second phase of operation, the first and second switch devices are closed, and the charge stored on the first charge storage device is transferred to the second charge storage device.

The integration circuit may further include a third switch device coupled between the intermediate node and ground, wherein, during the first phase of operation, the third switch device is closed, and the charge stored on the second charge storage device is transferred to the output node of the integration circuit. The integration circuit may further include a fourth switch device coupled between the second terminal of the second charge storage device and ground, wherein, during a third phase of operation, the fourth switch device is closed, and the second charge storage device is discharged to ground. The integration circuit may further include a second amplifier coupled between the output terminal of the first amplifier and the second switch device. The first, second, third and fourth switch devices may include transistors. The first and second charge storage devices may include capacitors.

According to another embodiment, an integration circuit includes an input node for receiving an input charge, an integrator having an input terminal coupled to the input node, an output terminal and a first charge storage device coupled between the input and output terminals, an intermediate node coupled between the input terminal and ground, a second charge storage device having a first terminal coupled to the intermediate node and a second terminal coupled to an output node of the integration circuit and an isolation device coupled between the integrator and the second charge storage device for selectively isolating the integrator from the second charge storage device. During a first phase of operation, the isolation device is activated and isolates the integrator from the second charge storage device, and the input charge received on the input terminal of the integrator is stored on the first charge storage device. During a second phase of operation, the isolation device is deactivated and enables and the charge stored on the first charge storage device to be transferred to the second charge storage device.

During a first portion of the first phase of operation, a charge stored on the second charge storage device may be read out to the output node of the integration circuit. During a second portion of the first phase of operation, the second charge storage device may be discharged to ground. The integration circuit may further include means for selectively connecting the first terminal of the second charge storage device to ground during the first portion of the first phase of operation. The isolation device may include a first switch device coupled between the input node and the intermediate node and a second switch device coupled between the output terminal of the integrator and the output node. The means for selectively connecting the first terminal of the second charge storage device to ground may include a switch device coupled between the intermediate node and ground, wherein, during the first portion of the first phase of operation, the third switch device is closed, and the charge stored on the second charge storage device is transferred to the output node of the integration circuit. The means for selectively connecting the second terminal of the second charge storage device to ground may include a switch device coupled between the second terminal of the second charge storage device and ground, wherein, during the second portion of the first phase of operation, the fourth switch device is closed, and the second charge storage device is discharged to ground. The first and second charge storage devices may each include a capacitor.

BRIEF DESCRIPTION OF THE DRAWINGS

The foregoing and other objects of this invention, the various features thereof, as well as the invention itself may be more fully understood from the following description when read together with the accompanying drawings in which.

DETAILED DESCRIPTION

Figure 1:
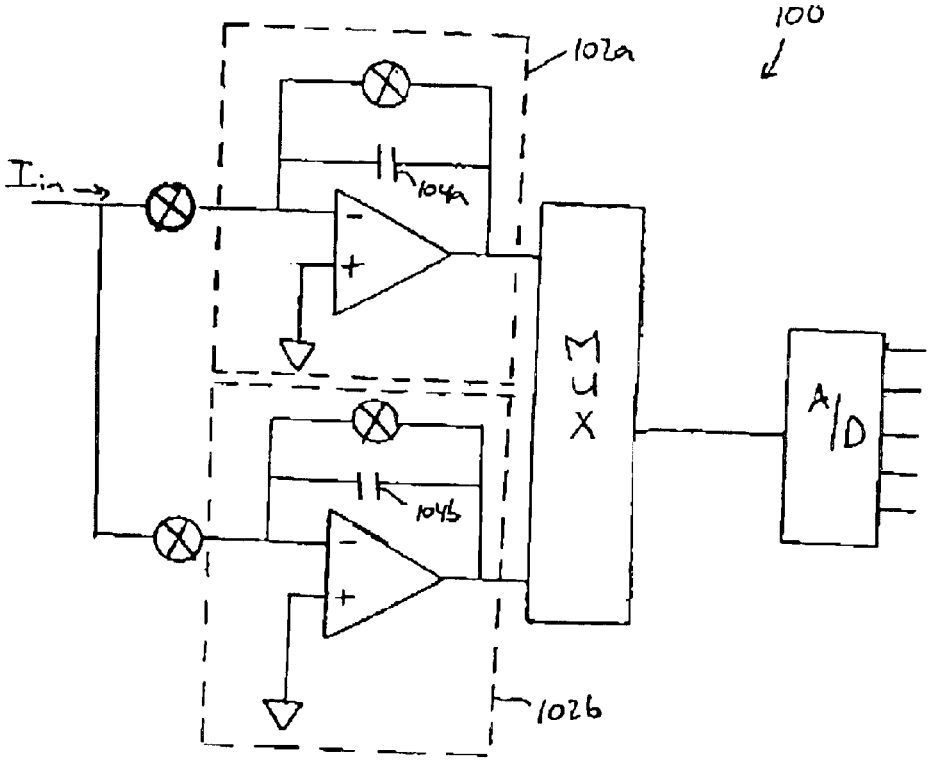
Fig. 1 (Prior Art)
FIG. 1 is a schematic diagram of a prior art device for processing an input charge from a CT device.
Figure 2:
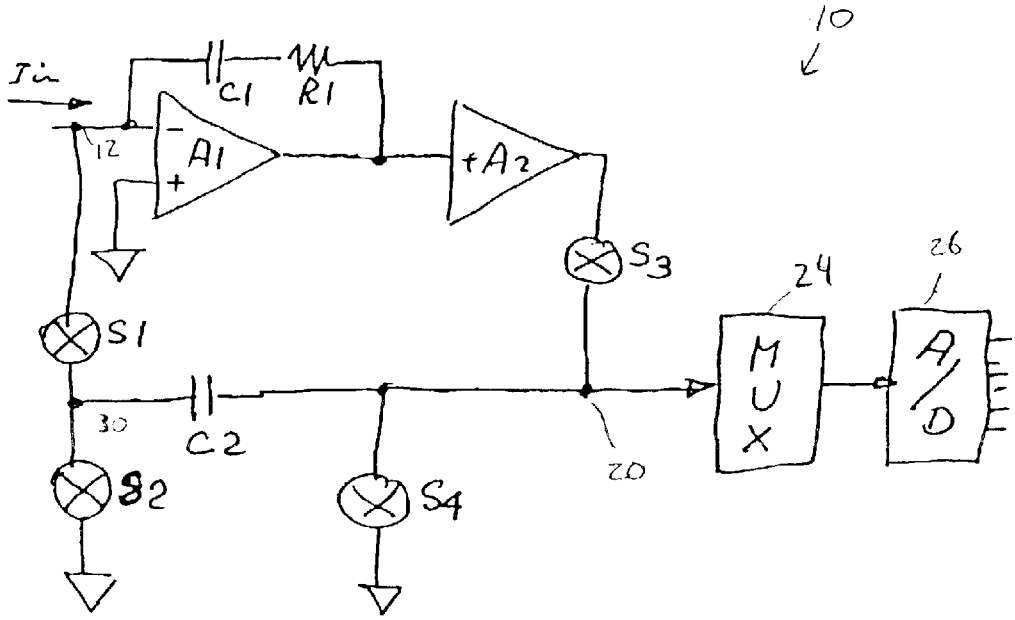
FIG. 2 is a schematic diagram of the integrator circuit of the present invention.

As is shown in FIG. 2, the integrating circuit 10 of the present invention includes a first amplifier $A_1$ having its inverting input connected to receive the input charge $I_{in}$ at input node 12 and its non-inverting input connected to ground. The output of amplifier $A_1$ is fed back to its inverting input through a resistor $R_1$ and capacitor $C_1$. The output of amplifier $A_1$ is also input to amplifier $A_2$, whose output is connected to an output node 20 through a switch $S_3$. Multiplexer 24 and analog-to-digital converter 26 are connected to output node 20 for further processing of the integrated signal read out from the integrating circuit 10. A switch $S_1$ is connected between the input node 12 and node 30 and a switch $S_2$ is connected between node 30 and ground. A capacitor $C_2$ is connected between node 30 and output node 20 and a switch $S_4$ is connected between node 20 and ground. Switches $S_1$, $S_2$, $S_3$ and $S_4$ are typically formed from transistors, each having a control input which, for example, closes the switch when the control input is high. However, it will be understood that the switches may be formed from any known switch device.

The operation of the integrating circuit of the present invention will now be described with reference to FIGS. 3A–3D, which show each of the four phases of operation of the circuit, and FIG. 4, which shows the state of each of the switches $S_1$, $S_2$, $S_3$ and $S_4$ during each of the phases. In the first phase of operation, switches $S_1$ and $S_3$ are turned off, or opened, at a time to, to isolate the portion of the circuit 10 shown in FIG. 3A from the rest of the circuit. This causes the charge $I_{in}$ received at input node 12 to be stored on capacitor $C_1$, while preventing the input charge $I_{in}$ from reaching capacitor $C_2$ and while isolating the charge accumulated on capacitor C, from output node 20. A voltage $V_0$ is output from the amplifier $A_1$ which is equal to $(I_{in} \cdot T)/C_1$; where T is the integration time. Also at time to, switch $S_2$ is turned on, or closed, and the charge stored on capacitor $C_2$ is read out via output node 20, FIG. 3B. After the charge stored on capacitor $C_2$ is read out via output node 20, capacitor $C_2$ is reset to zero, as shown in FIG. 3C, wherein switch $S_2$ remains closed and, at time $t_1$, switch $S_4$ is closed, causing capacitor $C_2$ to be completely discharged to ground through switch $S_4$. Note that both of the phases shown in FIGS. 3B and 3C take place during the integration time T during which the capacitor $C_1$, is being charged with the input charge $I_{in}$.

Figure 3D:
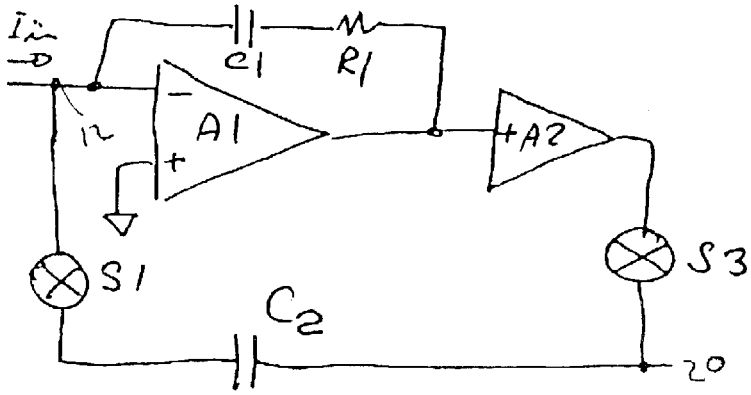
FIGS. 3A–3D are schematic diagrams of the circuit of FIG. 2 in different stages of operation, in which only the active components of the circuit during each stage of operation are shown in each figure.
Figure 3A:
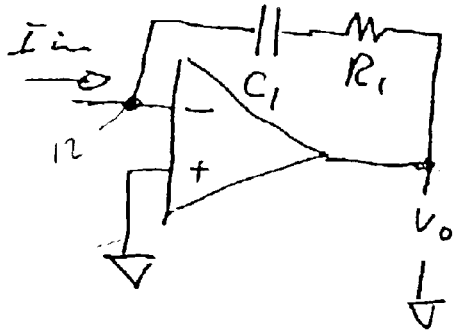
Figure 3B:
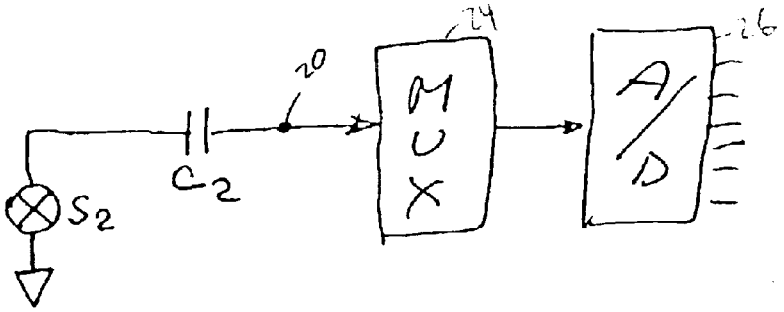
Figure 3C:
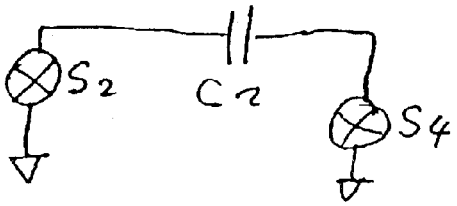
Figure 4:
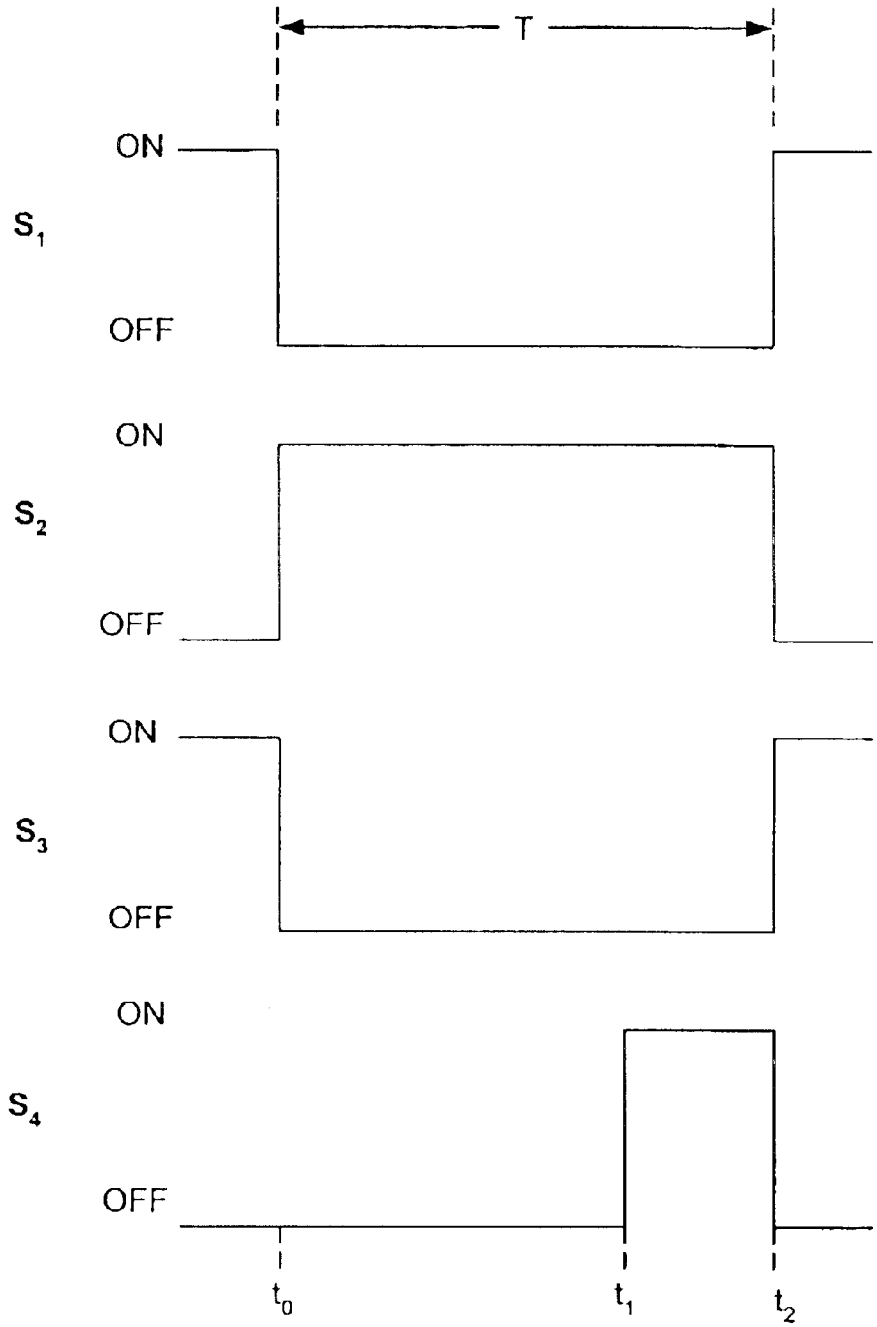
FIG. 4 is a schematic diagram showing the timing of the operation of the switches of the integrating circuit in accordance with the present invention.

In the next phase of operation, shown in FIG. 3D, the charge stored on capacitor $C_1$ is transferred to capacitor $C_2$. In this phase, at time $t_2$, switches $S_1$ and $S_3$ are turned on, or closed, and switches $S_2$ and $S_4$ are turned off, or opened. This enables amplifier $A_2$ to transfer the charge stored on capacitor $C_1$ through output node 20. During this mode of operation, amplifier $A_2$ forces the output of amplifier $A_1$ to its offset voltage which, for the purposes of the present invention, is an arbitrary, but stable voltage. Resistor $R_1$ operates to stabilize the transfer phase of the integration circuit 10. The circuit then returns to time to wherein switches $S_1$ and $S_3$ are opened, enabling the input charge $I_{in}$ to accumulate on capacitor $C_1$, and switch $S_2$ is closed, enabling the charge stored on capacitor $C_2$ to be read out from the circuit 10 via output node 20. This integrate, read and reset cycle is repeated for each view of the input data, typically 2000 times per second.

The configuration described above enables the charge accumulated on capacitor $C_2$ to be referenced to the input of amplifier $A_1$, since during the phase in which the charge is transferred to capacitor $C_2$, switch $S_1$ is closed and switch $S_2$ is open. However, during the read phase, the charge stored on capacitor $C_2$ is read out with respect to ground, since switch $S_1$ is open and switch $S_2$ is closed, thus isolating capacitor $C_2$ from amplifier $A_1$. This prevents the offset voltage of amplifier $A_1$ from being included in the charge read out via output node 20. Furthermore, since the input charge $I_{in}$ is never diverted from the input of amplifier $A_1$, no charge received by the integrator circuit is lost. It is either accumulated on capacitor $C_1$ during the first stage of operation, when switches $S_1$ and $S_3$ are open, or on capacitor $C_2$ during the last phase of operation, when switch $S_1$ is closed and the charge stored on capacitor C, is transferred to capacitor $C_2$.

Since the output charge of the integrator circuit is only read out from capacitor $C_2$, only the value of capacitor $C_2$ need be known to a high degree of accuracy in order to correctly calculate the charge read out via output node 20.

Accordingly, the present invention provides an integration circuit which is capable of integrating an input charge, reading out the charge and resetting, while not losing any of the charge input to the circuit. Since only a single amplifier circuit is used and the charge is read out from a single capacitor, there is no need for multiple offset and gain tables to compensate for differences between multiple amplifier circuits. The reduced component could compared to the prior art results in a device that requires less space to implement and which is less expensive to manufacture.

The invention may be embodied in other specific forms without departing from the spirit or essential characteristics thereof. For example, while the invention is described in the context of an integration circuit for use in a CT scanning device, it will be understood that the invention may be utilized in any environment where a charge or current must be integrated during the course of processing the charge or current. The present embodiments are therefore to be considered in respects as illustrative and not restrictive.

What is claimed is:

1. An integration circuit comprising:

input node for receiving an input charge;

an integrator including a first amplifier having an input terminal coupled to the input node, an output terminal and a first charge storage device coupled between the input and output terminals;

an intermediate node coupled between the input node and ground;

a second charge storage device having a first terminal coupled to the intermediate node and a second terminal coupled to an output node of the integration circuit;

a first switch device coupled between the input node and the intermediate node; and a second switch device coupled between the output terminal of the integrator and the output node;

wherein, during a first phase of operation, the first and second switch devices are open, and the input charge received on the input terminal of the integrator is stored on the first charge storage device; and during a second phase of operation, the first and second switch devices are closed, and the charge stored on the first charge storage device is transferred to the second charge storage device.

2. The integration circuit of claim 1 further comprising a third switch device coupled between the intermediate node and ground, wherein, during the first phase of operation, the third switch device is closed, and the charge stored on the second charge storage device is transferred to the output node of the integration circuit.

3. The integration circuit of claim 2 further comprising a four switch device coupled between the second terminal of the second charge storage device and ground, wherein, during a third phase of operation, the fourth switch device is closed, and the second charge storage device is discharged to ground.

4. The integration circuit of claim 3 further comprising a second amplifier coupled between the output terminal of the first amplifier and the second switch device.

5. The integration circuit of claim 4 wherein the first, second, third and fourth switch devices comprise transistors.

6. The integration circuit of claim 5 wherein the first and second charge storage devices each comprise a capacitor.

7. An integration circuit comprising:

an input node for receiving an input charge;

an integrator having an input terminal coupled to the input node, an output terminal and a first charge storage device coupled between the input and output terminals;

an intermediate node coupled between the input terminal and ground;

a second charge storage device baying a first terminal coupled to the intermediate node and a second terminal coupled to an output node of the integration circuit:

an isolation device coupled between the integrator and the second charge store device for selectively isolating the integrator from the second charge storage device;

wherein, during a first phase of operation, the isolation device activated and isolates the integrator from the second charge storage device, and the input charge received on the input terminal of the integrator is stored on the first charge storage device; and during a second phase of operation the isolation device is deactivated and enables and the charge stored on the first charge storage device to be transferred to the second charge storage device, wherein, during a first portion of the first phase of operation, a charge stored on the second charge storage device is read out to the output node of the integration circuit.

8. The integration circuit of claim 7 wherein, during a second portion of the firs phase of operation, the second charge storage device is discharged to ground.

9. The integration circuit of claim 8 further including means for selectively connecting the first terminal of the second charge storage device to ground during the first portion of the first phase of operation.

10. The integration circuit of claim 9 further including means for selectively connecting the second terminal of the second charge storage device to ground during the second portion of the first phase of operation.

11. The integration circuit of claim 10 wherein the isolation device comprises a first switch device coupled between the input node and the intermediate node; and a second switch device coupled between the output terminal of the integrator and the output node.

12. The integration device of claim 9 wherein the means for selectively connecting the first terminal of the second charge storage device to ground comprises a third switch device coupled between the intermediate node and ground, wherein, during the first portion of the first phase of operation, the third switch device is closed, and the charge stored on the second charge storage device is transferred to the output node of the integration circuit.

13. The integration device of claim 12 wherein the means for selectively connecting the second terminal of the second charge storage device to ground comprises a fourth switch device coupled between the second terminal of the second charge storage device and ground, wherein, during the second portion of the first phase of operation, the fourth switch device is closed, and the second charge storage device is discharged to ground.

14. The integration circuit of claim 7 wherein the first and second charge storage devices each comprise a capacitor.

15. The integration circuit of claim 13 wherein the first and second charge storage devices each comprise a capacitor.

16. An integration circuit comprising:

an input node for receiving an input charge;

an integrator having an input terminal coupled to the input node, an output terminal and a first charge storage device coupled between the input and output terminals;

an intermediate node coupled between the input terminal and ground;

a second charge storage device having a first terminal coupled to the intermediate node and a second terminal coupled to an output ode of the integration circuit;

an isolation device coupled between the integrator and the second charge storage device for selectively isolating the integrator from the second charge storage device;

wherein, during a first phase of operation, the isolation device is activated and isolates the integrator from the second charge storage device, and the input charge received on the input terminal of the integrator is stored on the first charge storage device; and during a second phase of operation, the isolation device is deactivated and enables and the charge stored on the first charge storage device to be transferred to the second charge storage device, wherein the isolation device comprises a first switch device coupled between the input node and the intermediate node; and a second switch device coupled between the output terminal of the integrator and the output node.

* * * * *

UNITED STATES PATENT AND TRADEMARK OFFICE

CERTIFICATE OF CORRECTION

PATENT NO. : 6,836,171 B1
DATED : December 28, 2004
INVENTOR(S) : Hans J. Weedon It is certified that error appears in the above-identified patent and that said Letters Patent is hereby corrected as shown below:

Column 4,
Line 67, before “input”, insert thereof -- an --;

Column 5,
Line 48, after “device”, delete “baying”, and insert thereof -- having --;
Line 52, after “charge”, delete “store”, and insert thereof -- storage --;
Line 56, before “activated”, insert thereof -- is --;

Column 6,
Line 47, after “output”, delete “ode”, and insert thereof -- node --.

Signed and Sealed this

Twenty-sixth Day of April, 2005

JON W. DUDAS
*Director of the United States Patent and Trademark Office*